US006109312A

United States Patent [19]

Sawyer et al.

[11] Patent Number: 6,109,312

[45] Date of Patent: Aug. 29, 2000

[54] AIR EVACUATION INSERT FOR WOOD CHIP DIGESTER

[76] Inventors: Michael D. Sawyer, 17 Riverview Cir., Litchfield, N.H. 03052; Thomas O. Morrow, 42 Marty Dr., Merrimack, N.H. 03054

[21] Appl. No.: 09/263,326

[22] Filed: Mar. 5, 1999

[51] Int. Cl.[7] ..... B65B 1/06

[52] U.S. Cl. ..... 141/65; 141/59; 141/93; 141/286; 162/237; 162/246

[58] Field of Search ..... 141/7, 59, 65, 141/93, 286; 162/17, 237, 246

[56] References Cited

U.S. PATENT DOCUMENTS

| | | | |
|---|---|---|---|
| 1,998,875 | 4/1935 | Koda | 162/246 |
| 3,294,625 | 12/1966 | Gessner . | |
| 3,347,741 | 10/1967 | Hutchison | 162/241 |
| 3,358,059 | 12/1967 | Snyder . | |
| 3,814,664 | 6/1974 | Carlsmith . | |
| 4,096,027 | 6/1978 | Sherman | 162/18 |
| 4,135,966 | 1/1979 | Glöersen | 162/17 |
| 5,443,102 | 8/1995 | Svendsen | 141/10 |
| 5,700,355 | 12/1997 | Prough | 162/246 |
| 5,873,393 | 2/1999 | Kordt | 141/286 |

FOREIGN PATENT DOCUMENTS 717744 9/1965 Canada .

OTHER PUBLICATIONS

"Beloit Steampacking System" —Beloit Corporation—1998.

*Primary Examiner*—J. Casimer Jacyna
*Attorney, Agent, or Firm*—Patrick V. G. Stiennon

[57] ABSTRACT

An insert is bolted to the inlet of a wood chip digester to provide air exhaust during chip loading, and over pressure relief during chip processing. The insert has an upper flange which connects to an overhead chip valve, and a lower flange which mates with the top of the digester inlet. The insert has an outer cylindrical section extending between the upper flange and the lower flange and a lower conical section which extends downwardly into the digester. An inner cylindrical sleeve is positioned coaxially with, and joined to, the outer wall by a conical ring at the top, and is joined to the conical section at the bottom. The outer wall, the conical section, and the inner cylindrical sleeve form a sealed volume, which maybe partitioned into two parts. The first part has a sector between the outer wall and the inner cylindrical sleeve which is connected to a pressure relief fitting, a portion of the sector being porous for allowing pressure relief through the fitting. The second part has a sector between the outer wall and the inner cylindrical sleeve and the entire volume between the cylindrical sleeve and the lower conical section. The second volume is connected to an air evacuation fitting. A portion of the lower conical section which extends around the conical section is formed with approximately thirty to forty percent open area formed by a multiplicity of drilled holes.

7 Claims, 4 Drawing Sheets

AIR EVACUATION INSERT FOR WOOD CHIP DIGESTER

CROSS REFERENCES TO RELATED APPLICATIONS

STATEMENT AS TO RIGHTS TO INVENTIONS MADE UNDER FEDERALLY SPONSORED RESEARCH AND DEVELOPMENT

BACKGROUND OF THE INVENTION

The present invention relates to means for loading wood chips into a chip digester.

Many grades of paper are manufactured from wood fibers which have been freed from the lignin which binds wood fibers together in wood. The lignin is dissolved by means of one of several chemical systems. The digestion process involves cutting the raw wood logs into wood chips which have a uniform thickness, and subjecting the wood chips to the chemical solvent under heat and pressure in a digester. A digester is a large pressure vessel in which wood chips are cooked under pressure to remove lignin, leaving so-called chemically processed wood fibers which are further processed and made into paper.

Because wood chips are typically processed in a batch process, an important aspect of the efficiency of the digestion process is minimizing the time required to load wood chips into the digester. Modern chip digesters are fabricated with air vents near the top of the digester which allow controlled removal of air from the digester as air is displaced by infeeding wood chips. Removal of air through a vent connected to the digester allows processing of the vented air to remove particles and droplets of the cooking liquor, and at the same time allows the free flow of wood chips into the digester from an overhead bin or hopper.

However older digesters were constructed without air vents and instead the air was allowed to flow upwardly through the infeeding chips and into and through the overhead chip bin. Upgrading older digester to add an air vent is an expensive and time consuming process. Digesters are pressure vessels and must conform to the ASME Pressure Vessel Code governing the construction and modification of pressure vessels. Such ASME code provisions or similar state and local codes are designed to assure safe construction, transportation, installation, and operation of boilers and pressure vessels.

Modifying an existing pressure vessel requires the entire pressure vessel to be tested in accordance with applicable code provisions. Further issues of material compatibility, weld cleanliness, weld heat effects, weld embrittlement, etc., complicate the modification of an existing digester. Significant down time required for the repair and certification under the various codes also makes modification of an existing digester expensive.

What is needed is a device or method for modifying existing digesters to vent air while loading wood chips which is less costly and results in less downtime.

SUMMARY OF THE INVENTION

The apparatus of this invention is an insert which is bolted to an existing digester chip inlet and provides air exhaust and over pressure relief.

The insert may be fabricated to fit an existing digester inlet and can be tested to ASME code as a separate integral unit. The air venting insert consists of an upper flange which mates with a valve leading to a wood chip bin, and a lower flange which mates with the top of the digester inlet. The insert has an outer wall which has a cylindrical section which extends between the upper flange and the lower flange and a lower conical section which tapers inwardly as it extends downwardly into a digester. An inner cylindrical sleeve is positioned coaxially with the outer wall and the conical section and is joined to the outer wall by a conical ring at the top and a planar ring at the bottom.

The outer wall, the conical section, and the inner cylindrical sleeve forms a sealed volume with the conical ring and the planar ring. The volume maybe partitioned into two parts. The first part consists of a 120 degree sector between the outer wall and the inner cylindrical sleeve which is connected to a pressure relief fitting. The second part consists of the remaining 240 degree sector between the outer wall and the inner cylindrical sleeve and the entire volume between the cylindrical sleeve and the lower conical section. The second part volume is connected to an air evacuation fitting. A portion of the inner cylindrical sleeve forming part of the 120 degree sector is formed of a porous screen through which air can be vented. A portion of the lower conical section which abuts the lower ring and extends completely around the conical section is formed with approximately 30–40 percent open area. The open area is formed by a multiplicity of holes of approximately one-quarter inch in diameter. Air is withdrawn through the open area and through the air evacuation fitting as wood chips are loaded into the digester through the insert.

It is a feature of the present invention to provide an insert for use with existing wood chips digesters which provides for the ventilation of the digester while chips are loaded into the digester.

It is another feature of the present invention to provide a means wherein the function of a pressure vessel may be modified without requiring recertification of the pressure vessel.

It is a still further feature of the present invention to provide a mechanism for more rapidly loading wood chips into a digester.

Further objects, features and advantages of the invention will be apparent from the following detailed description when taken in conjunction with the accompanying drawings.

DESCRIPTION OF THE PREFERRED EMBODIMENTS

Figure 1:
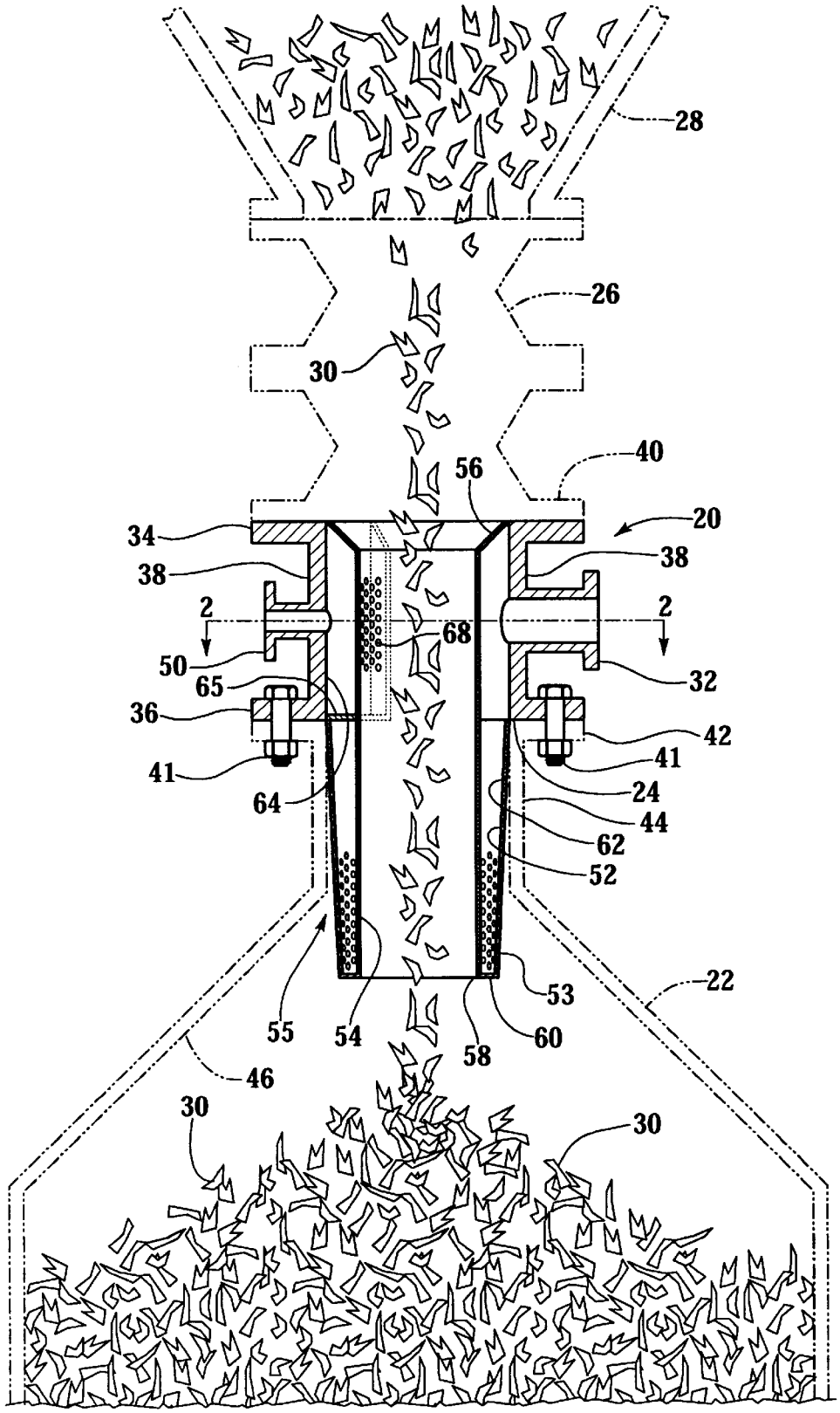
FIG. 1 is a cross-sectional view of the insert of this invention shown in relation to a chip hopper and digester shown in phantom view.
Figure 2:
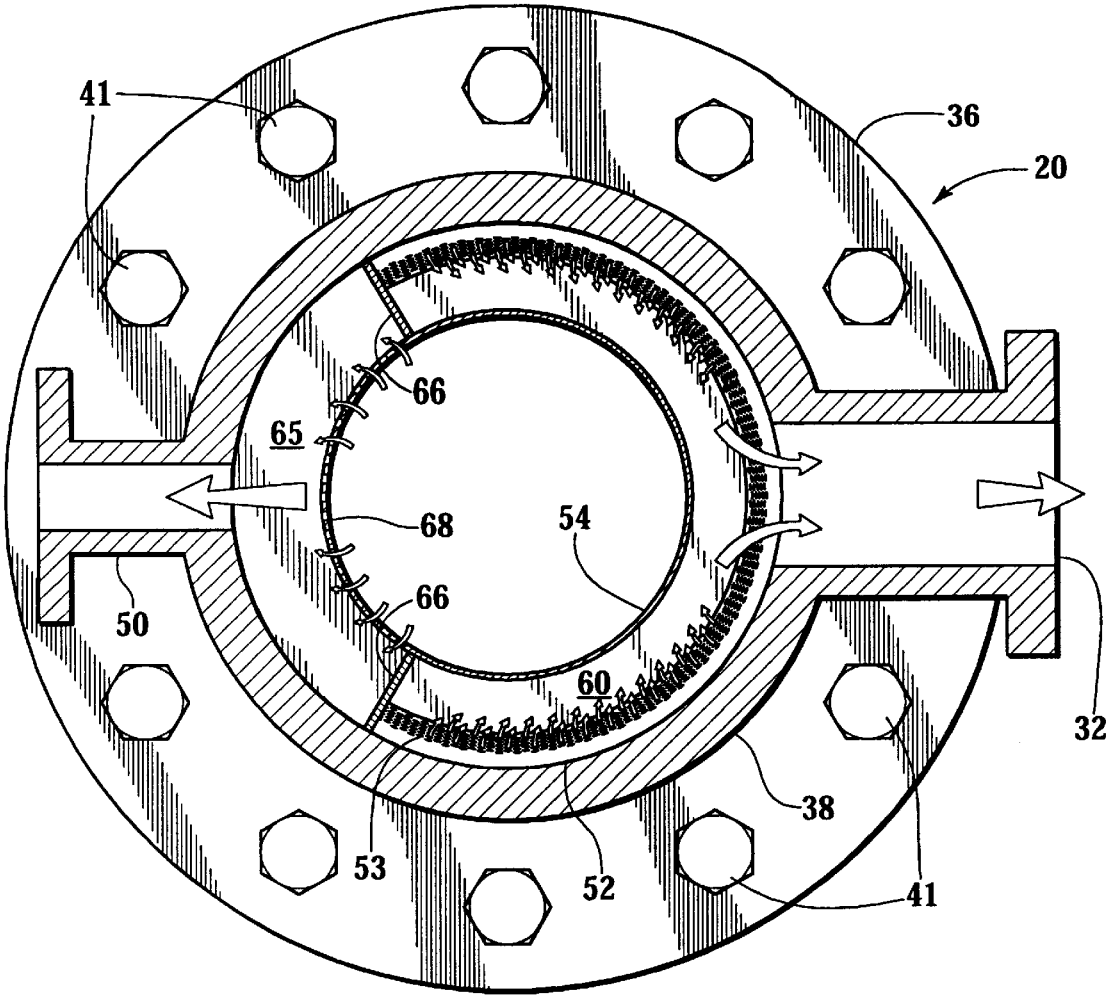
FIG. 2 is a cross-sectional view with exaggerated perspective of the insert of FIG. 1 taken along section line 2—2.
Figure 3:
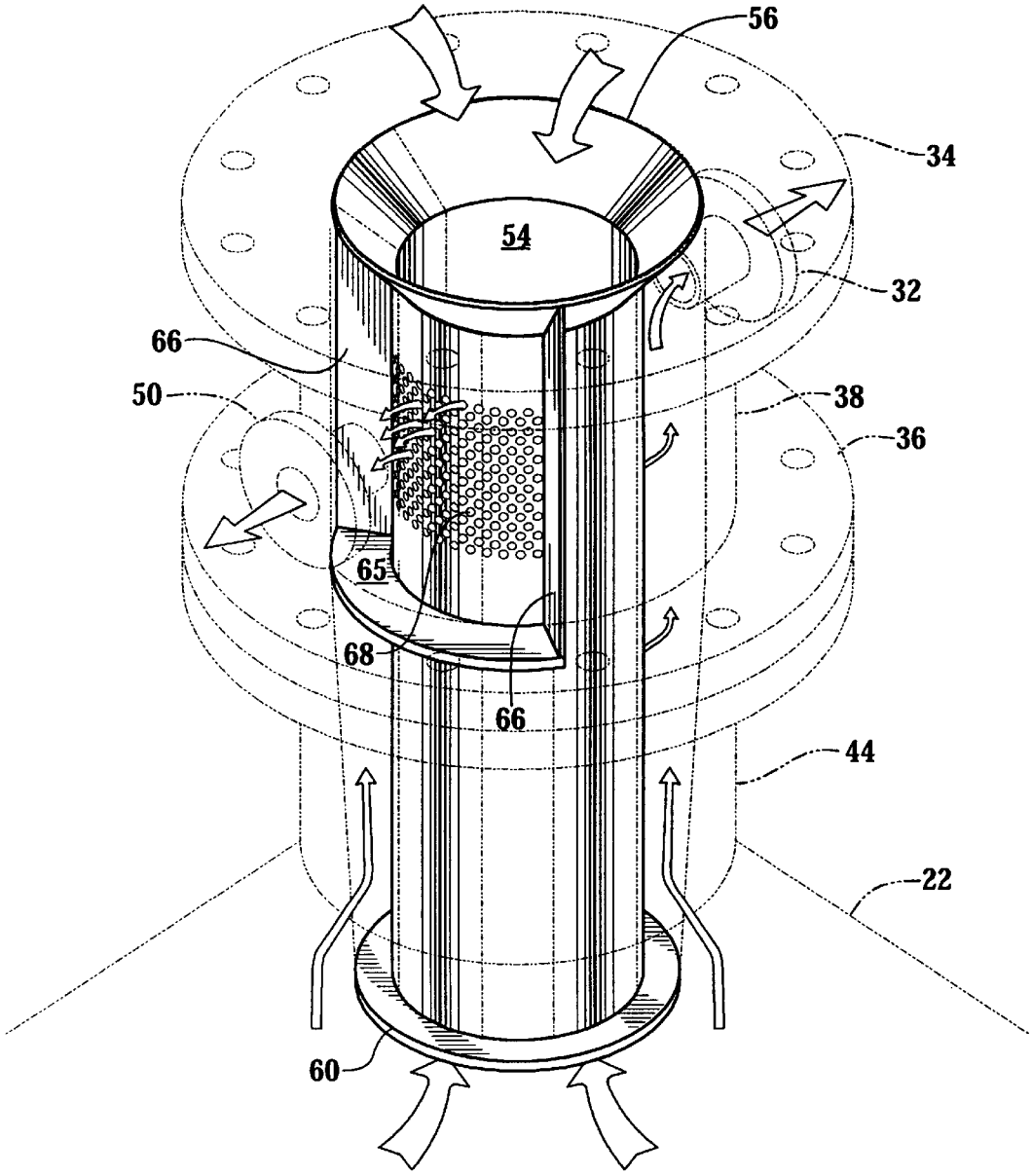
FIG. 3 is an isometric view of the insert of FIG. 1 with a portion of the insert shown in phantom view.
Figure 4:
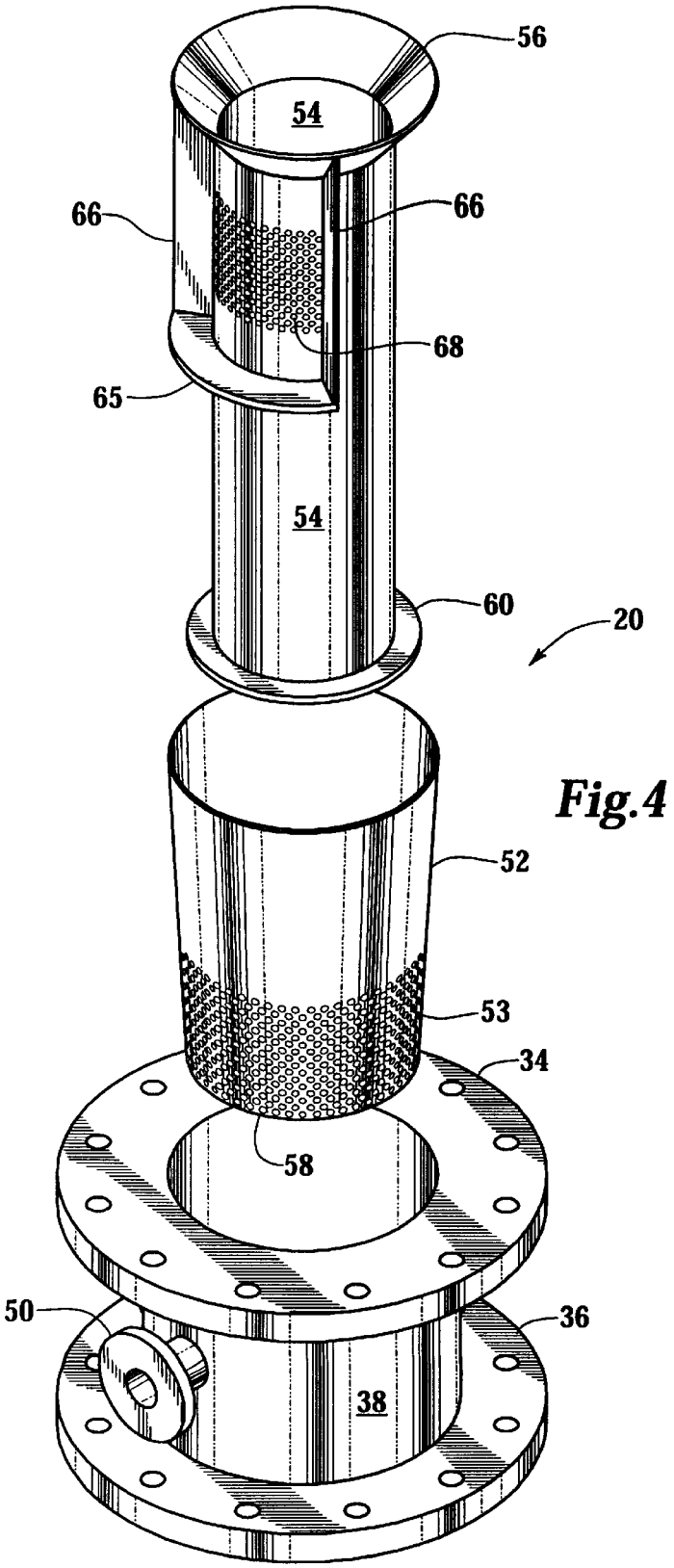
FIG. 4 is an exploded isometric view of the insert of FIG. 1.

Referring more particularly to FIGS. 1–3 wherein like numbers refer to similar parts, an air evacuation insert or nozzle 20 is shown in FIG. 1. The insert 20 is mounted to a chip digester 22 at a wood chip inlet 24. The insert 20 is mounted between the digester inlet 24 and a wood chip valve 26. A wood chip hopper, chute or bin 28 is positioned above the valve 26 and supplies wood chips 30 to the digester 22 through the insert 20 and the inlet 24. While chips 30 are being loaded through the insert 20, air is drawn from the inside of the digester 22 through an air evacuation fitting 32.

As wood chips 30 fill the digester 22, air is displaced and, if no provision for withdrawing the displaced air is provided, the air will be forced to flow upwardly through the wood chips into the wood chip bin 28. This is undesirable because the upward flow of air retards the downward movement of the wood chips 30, increasing the time required to fill the digester 22.

The insert 20 allows air to be withdrawn from an existing digester 22 without affecting the downward movement of the wood chips. The digester 22 can therefore exhibit increased productivity by increasing the speed at which the digester can be loaded without modifying the digester 22 itself. Modifications to the digester 22 are difficult because the digester is a pressure vessel which must meet various safety standards such as those set forth in the ASME Pressure Vessel Code. Although the insert 20 must meet ASME code, it can be made to satisfy the code with much less difficulty as it is a relatively small integral device which can be tested at the factory, or readily shipped to a test facility.

The insert 20 is fabricated from an upper flange 34 and a lower flange 36 which are connected by an outer cylindrical wall 38. The upper flange 34 is connected to a lower valve flange 40 extending from the valve 26 by bolts (not shown). The lower flange 36 of the insert 20 is connected by bolts 41 to an inlet flange 42 which extends from the digester inlet 24. The inlet flange 42 connects to a cylindrical pipe section 44 of the digester 22 which leads into the main volume 46 of the digester.

The insert air evacuation fitting 32 penetrates the cylindrical wall 38 and is located opposite a smaller vent 50 which also penetrates the cylindrical wall 38. An outer conical wall 52 is connected to the insert cylindrical wall 38 at or above the lower flange 36. The outer conical wall 52 extends downwardly into the cylindrical pipe section 44 forming the inlet 24, and extends below the pipe section 44 of the digester inlet 24 into the main volume 46 of the digester 22. A portion 53 of the outer conical wall 52 consisting of approximately the lower forty percent of the circumference of the conical wall 52 is rendered permeable by a plurality of one-quarter inch holes. Because the outer conical wall 52 is tapered, a gap 55 is formed between the conical wall 52 and the pipe section 44 the previous character. The gap 55 allows air to be drawn through the conical wall 52 even where it is surrounded by the pipe section 44, with the result that the overall length of the conical wall 52 is less then it otherwise would be.

An inner cylindrical sleeve 54 is joined to the insert upper flange 34 by a conical ring 56, and is joined to the bottom 58 of the conical wall 52 by a planar ring 60. Two volumes are defined between the inner cylindrical sleeve 54, the outer cylindrical wall 38 and the conical wall 52. The first volume or duct 62 defines a flow passage between the air evacuation fitting 32 and the permeable portion 53 of the conical wall 52. A second volume or duct 64 is set off from the first volume 62 by a radially extending baffle 65 which extends between the inner cylindrical sleeve 54 and the outer cylindrical wall 38 at a position adjacent to the lower flange 36. A sector of a ring 65 extends between the outer cylindrical wall 38 and the inner cylindrical sleeve 54 beneath the vent 50. Two axially and radially extending baffles 66 extend from the ring sector 65 to the conical ring 556 and extend between the outer cylindrical wall 38 and the inner cylindrical sleeve 54. The ring sector 65 is positioned at the transition from the outer cylindrical wall 38 to the lower conical wall 52. The first volume 62, as shown in FIG. 3, provides a flow passage for gases within the digester which is always open and which does not interfere with the in flow of wood chips.

A portion 68 of the inner cylindrical sleeve 54 which forms part of the second volume is rendered permeable by a multiplicity of holes formed or drilled through the inner cylindrical sleeve 54. The holes are drilled in the flat plate before the insert is formed and welded together. The holes allow relief gases to flow from the interior of the digester 46 to the vent 50. The second volume 64 provides a fluid escape passage which is in direct communication with a pressure relief device such as a relief valve. Live steam can also be injected through the vent 50 to clean the holes drilled and the portion 68 of the inner cylindrical sleeve.

The insert 20 is formed as a weldment. The portion of the insert 20 between the flanges 34, 36 is a pressure vessel which must meet ASME code. The flanges are typically forged carbon steel and the outer wall 38 is heavy gauge stainless steel type 316 L, although more chemically resistant types of stainless steel may be used if necessary. The inner cylindrical sleeve 54, the outer conical wall 52 and the conical ring 56 and planar ring 60 do not directly see high pressures and thus can be fabricated from one-quarter inch stainless steel.

In some circumstances it may be desirable to construct a insert with only a single volume which communicates between the permeable portion 53 and both the air evacuation fitting 32 and the pressure relieve vent 50. If a insert is so constructed only the single permeable area 53 is required and the insert will be identical to that shown in FIG. 3 only the permeable portion 68 and baffles 66 and 65 will not be used. In such a insert air will be drawn from the evacuation fitting 32 while the digester 22 is being filled and pressure relief will be provided through the vent 50 if necessary during digestion. Thus the cylindrical wall 38 and the outer cylindrical wall 38, the conical wall 52 will form a single duct.

The dimensions of the air evacuation insert 20 will vary with the size of a particular digester. By way of example, the outer cylindrical wall 38 may be twenty-four to thirty-six inches in diameter and be about ninety-six inches from top to bottom, while the permeable portion of the conical wall section has an open area of about 543 square inches representing thirty percent of the area of a twenty-four inch diameter cone approximately twenty-four inches long. As illustrated the permeable portion of the cylindrical wall extends 18 inches into the digester chamber 46.

It is understood that the invention is not limited to the particular construction and arrangement of parts herein illustrated and described, but embraces such modified forms thereof as come within the scope of the following claims.

We claim:

1. An apparatus for mounting in a wood chip digester chip inlet, comprising:

a first flange;

a second flange in spaced parallel relation with the first flange, the first flange and the second flange defining an axis along which the first flange and the second flange are spaced;

a cylindrical wall having a cylindrical axis lying along the defined axis, the cylindrical wall extending between the first flange and the second flange;

a conical wall having an axis lying along the defined axis, the conical wall being joined to the cylindrical wall, the conical wall tapering inwardly toward the defined axis as the conical wall extends away from the first flange and the second flange;

an inner cylindrical sleeve defining a cylindrical axis lying along the defined axis, the inner cylindrical sleeve being spaced inwardly of the cylindrical wall and the conical wall;

a conical ring extending inwardly from an uppermost portion of the cylindrical wall to an uppermost portion of the inner cylindrical sleeve;

a planar ring joining a lowermost portion of the cylindrical sleeve to a lowermost portion of the conical wall;

a plurality of baffle plates extending between the cylindrical sleeve and the cylindrical wall to define a first volume therebetween;

a first fitting mounted to portions of the cylindrical wall which define an opening, the first fitting communicating through the opening with the first volume;

a portions of the cylindrical sleeve adjacent the first volume which define a permeable surface through which fluid may pass;

a second fitting mounted to the cylindrical wall and spaced from the first fitting and not in communication with the first volume, the second fitting communicating with a second volume defined by the cylindrical wall, the conical wall, the cylindrical sleeve, the conical ring and the planar ring, and the plurality of baffle plates separating the first volume from the second volume;

portions of the conical wall which define a permeable surface through which fluid may pass into the second volume, wherein the apparatus is an integral unit formed of metal, adapted to be used to supply wood chips to a wood chip digester while simultaneously withdrawing air from said wood chip digester.

2. The apparatus of claim 1 wherein the cylindrical wall has a diameter of between about twenty-four inches and about thirty-six inches.

3. The apparatus of claim 1 wherein the apparatus is fabricated as a steel weldment.

4. An apparatus for loading wood chips into a chip digester comprising:

a container of wood chips emptying into a pressure vessel forming a chip digester;

an insert removably positioned between the container of wood chips and the pressure vessel, so that wood chips flow through the insert, the insert sealable to the pressure vessel;

the insert having an inner wall which defines a path along which wood chips flow;

the insert having a first vent which communicates by means of a duct to a first screen which is positioned within the pressure vessel and faces away from the inner wall, and away from the path along which wood chips flow; and the insert having a second vent which communicates by means of a duct to a second screen which forms part of the inner wall facing the path along which wood chips flow.

5. The apparatus of claim 4 wherein the insert has an outer cylindrical wall positioned between an upper flange and a lower flange and a downwardly extending outer wall which extends down into the pressure vessel, the downwardly extending outer wall having a circumferential portion which forms the first screen so that air may be drawn through the outer wall, through the first vent.

6. The apparatus of claim 5 wherein the downwardly extending outer wall is conical and tapers inwardly as it extends upwardly, and wherein the pressure vessel has a substantially cylindrical pipe wall.

7. An air evacuation insert for a wood chip digester, comprising:

an upper flange;

an outer pipe wall extending downwardly from the upper flange;

a lower flange extending outwardly from the outer pipe wall below the upper flange;

an inner pipe wall positioned within the outer pipe wall and connected thereto;

portions of the outer pipe wall which define an air evacuation outlet;

an outer converging pipe wall connected to the outer pipe wall and extending downwardly beneath the lower flange, wherein the inner pipe wall extends downwardly within the outer converging pipe wall and is connected to the outer converging pipe wall;

portions of the outer converging pipe wall defining a plurality of air inlet openings, wherein a first duct is defined between the inner pipe wall and the outer pipe wall and outer converging pipe wall, the first duct extending from the air inlet openings to the air evacuation outlet;

portions of the inner pipe wall which define a perforated region forming a plurality of openings extending between the interior of the inner pipe wall and the exterior of the inner pipe wall;

baffles which extend between the inner pipe wall and the outer pipe wall around the perforated region to define a second duct which is blocked from communication with the first duct; and portions of the outer pipe wall which define an pressure relief outlet, the second duct communicating between the interior of the inner pipe wall and the pressure relief outlet.

* * * * *